US007409180B2

(12) United States Patent
Seo

(10) Patent No.: US 7,409,180 B2
(45) Date of Patent: Aug. 5, 2008

(54) IMAGE FORMING APPARATUS HAVING TONER REMOVER TO REMOVE TONER LEAKED FROM TONER CARTRIDGE

(75) Inventor: Insik Seo, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 308 days.

(21) Appl. No.: 11/272,749

(22) Filed: Nov. 15, 2005

(65) Prior Publication Data

US 2006/0257172 A1 Nov. 16, 2006

(30) Foreign Application Priority Data

Mar. 15, 2005 (KR) ..... 10-2005-0021342

(51) Int. Cl.
*G03G 15/08* (2006.01)

(52) U.S. Cl. ..... 399/258; 399/260

(58) Field of Classification Search ..... 399/106, 399/252, 258, 262, 263, 358, 360
See application file for complete search history.

(56) References Cited

U.S. PATENT DOCUMENTS

| | | | | |
|---|---|---|---|---|
| 5,018,560 | A * | 5/1991 | Tsukamoto | 399/258 |
| 6,314,261 | B1 * | 11/2001 | Omata et al. | 399/258 |
| 6,556,801 | B1 * | 4/2003 | Shimaoka et al. | 399/258 |
| 7,020,428 | B2 | 3/2006 | Park et al. | |

FOREIGN PATENT DOCUMENTS

| | | |
|---|---|---|
| JP | 60-104971 | 6/1985 |
| JP | 2-153385 | 6/1990 |
| JP | 5-53434 | 3/1993 |
| JP | 8-50441 | 2/1996 |
| JP | 8-194417 | 7/1996 |
| JP | 9-6212 | 1/1997 |
| KR | 2004-58925 | 7/2004 |

OTHER PUBLICATIONS

Notice to Submit Response issued Apr. 25, 2006 by the Korean Intellectual Property Office re: Korean Patent Application No. 2005-21342 (5 pp).
Office Action issued in Chinese Patent Application No. 2005101301990 on Nov. 16, 2007.

* cited by examiner

*Primary Examiner*—David M Gray
*Assistant Examiner*—Ryan D. Walsh
(74) *Attorney, Agent, or Firm*—Stein, McEwen & Bui, LLP

(57) ABSTRACT

An image forming apparatus capable of removing leaked toner includes: a toner cartridge storing a toner and having a toner supply window for supplying the toner; a housing for detachably accommodating the toner cartridge; and a toner receptacle provided to the housing receiving the toner leaking from the toner cartridge when the toner cartridge is detached from the housing. The image forming apparatus also includes a toner remover to remove the toner adhered to the outer periphery of the toner cartridge. As a result, the inner and outer peripheries of the image forming apparatus are not polluted, and the components of the image forming apparatus function properly.

23 Claims, 7 Drawing Sheets

IMAGE FORMING APPARATUS HAVING TONER REMOVER TO REMOVE TONER LEAKED FROM TONER CARTRIDGE

CROSS-REFERENCE TO RELATED APPLICATIONS

This application claims the benefit of Korean Patent Application No. 2005-21342, filed on Mar. 15, 2005 in the Korean Intellectual Property Office, the disclosure of which is incorporated herein in its entirety by reference.

BACKGROUND OF THE INVENTION

1. Field of the Invention

Aspects of the present invention relate to an image forming apparatus, and more particularly, to an image forming apparatus having a toner remover for removing toner leaked from a toner cartridge.

2. Description of the Related Art

In general, an image forming apparatus forms a desired image by radiating light onto a photosensitive medium charged to a desired potential to make an electrostatic latent image thereon, and transferring and fixing the latent image on a recording medium with toner. Such an image forming apparatus includes a toner cartridge for storing the toner. In particular, a large image forming apparatus generally employs a bottle-type toner cartridge.

FIG. 1 schematically shows a toner cartridge that can be attached to a conventional image forming apparatus. As shown in FIG. 1, when a toner attaching portion 10 is attached to a housing 30, a shutter 22 closing a toner supply window 20 is opened when the attachment is completed, so that toner stored in the toner cartridge is supplied to a developing cartridge (not shown). A force is applied to the toner cartridge 10 when the toner cartridge 10 is detached from the housing 30, and the toner cartridge 10 is detached from the housing 30 in the arrow direction. At this time, the shutter 22 covers the toner supply window 20 to prevent leakage of the toner.

As described above, since the force is applied to the toner cartridge 10 when the cartridge 10 is detached from the housing 30, the toner leaks through the toner supply window 20, so that the toner adheres to an outer portion of the toner cartridge 10 and an inner portion of the housing 30. The toner adhered to the outer portion of the toner cartridge 10 moves together with the toner cartridge 10 when it is detached, so that the toner drops from the toner cartridge 10, thereby polluting the housing 30, an interior of the image forming apparatus, and components thereof.

Thus, the quality of a printed image is poor and the document must be reprinted after cleaning the apparatus.

SUMMARY OF THE INVENTION

Aspects of the present invention provide an image forming apparatus capable of preventing toner from leaking when a toner cartridge is attached to or detached from the image forming apparatus.

Another aspect of the present invention is to provide an image forming apparatus capable of preventing deterioration of an image due to components polluted by leaked toner.

According to an aspect of the present invention, there is provided an image forming apparatus comprising: a toner cartridge storing a toner and having a toner supply window supplying the toner; a housing for detachably accommodating the toner cartridge; and a toner receptacle provided to the housing for receiving the toner leaking from the toner cartridge when the toner cartridge is detached from the housing.

In accordance with an aspect of the invention, the toner cartridge includes a toner transfer member installed in the toner cartridge for transferring the toner contained in the toner cartridge to the toner supply window.

In accordance with an aspect of the invention, the toner transfer member is a rotatable auger.

In accordance with an aspect of the invention, the toner cartridge includes a shutter for opening and closing the toner supply window when the toner cartridge is attached to or detached from the housing, and a toner remover installed on the housing for removing the toner leaking from the toner cartridge when the toner cartridge is detached form the housing.

In accordance with an aspect of the invention, the toner remover includes a toner removing member protruding from an inner periphery of the housing.

In accordance with an aspect of the invention, the toner receptacle is detachably installed to the housing.

In accordance with an aspect of the invention, the toner remover includes an opening formed at one side of the housing corresponding to a moving trajectory of the shutter when the toner cartridge is attached to or detached from the housing, and a biasing portion provided to the opening for pressing the shutter to remove the toner adhered to the shutter when the toner cartridge is detached from the housing.

In accordance with an aspect of the invention, the biasing portion has a first member contacting the shutter to remove the toner leaking from the housing, a second member installed to the housing for covering the opening, and a resilient member installed between the first member and the second member for biasing the first member against the opening.

The first member has an interfering portion interfering with the housing for restricting a movement of the first member to prevent the first member from escaping from the opening.

The first member has a convex portion protruding towards the opening.

The convex portion point-contacts the shutter.

The image forming apparatus further comprises a toner storing portion for storing the toner removed by the first member.

The toner storing portion is detachably installed to the housing.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
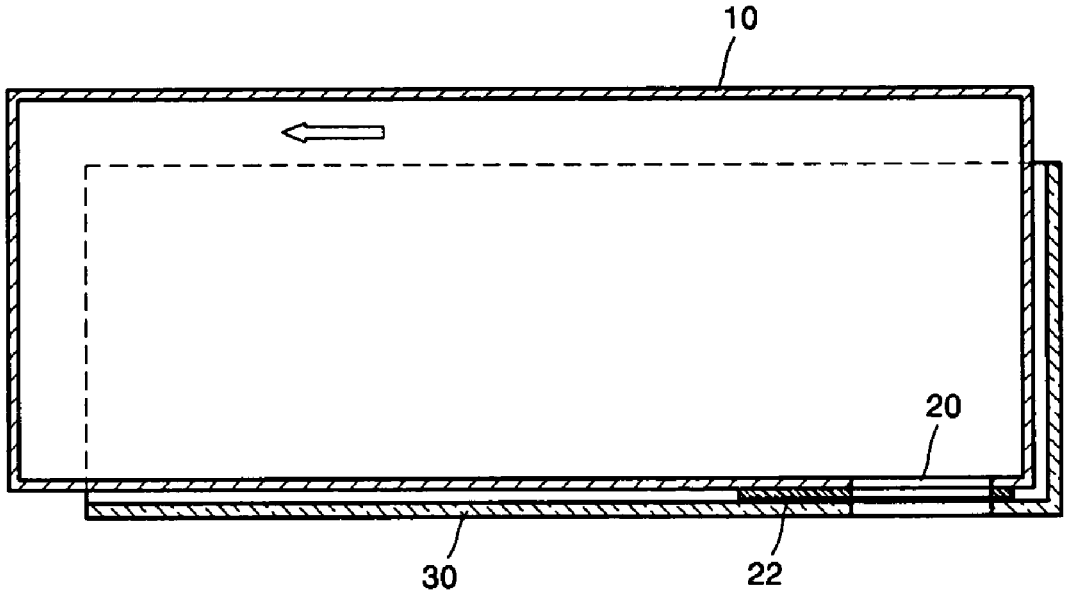
FIG. 1 (RELATED ART)
FIG. 1 is a schematic view of a toner cartridge for a conventional image forming apparatus.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

The present invention is applied to a monochromatic-electrophotographic image forming apparatus employing a bottle-type toner cartridge, but is not limited thereto.

Figure 2:
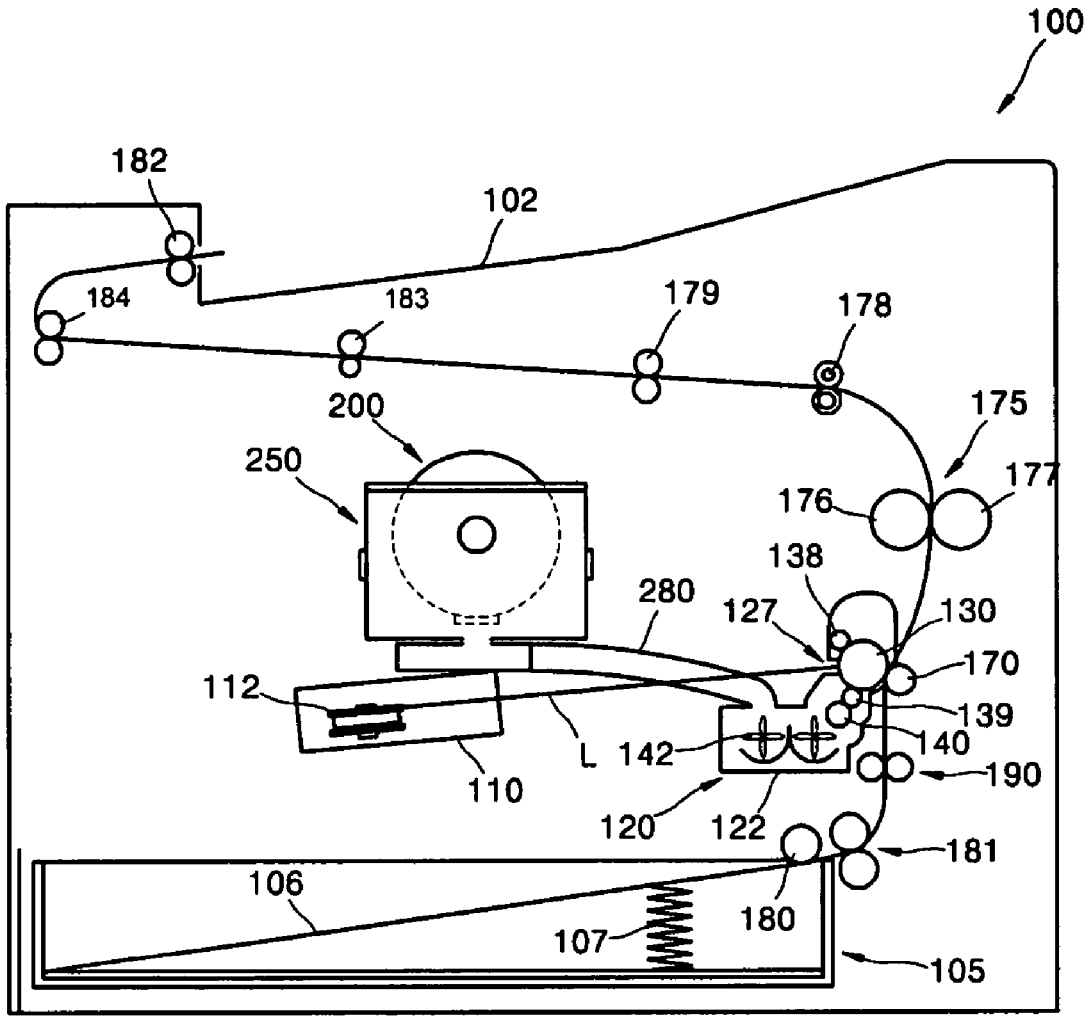
FIG. 2 is a cross-sectional view schematically illustrating an image forming apparatus according to an embodiment of the present invention.

FIG. 2 is a cross-sectional view schematically illustrating an image forming apparatus 100 according to an embodiment of the present invention. Referring to FIG. 2, the image forming apparatus 100 includes a light emitting unit 110, a toner cartridge 200, a housing 250 for accommodating the toner cartridge 200, a developing cartridge 120, a fixing unit 175, and a paper feeding cassette 105.

The light emitting unit 110 is disposed under the housing 250, and emits light L onto a photosensitive medium 130 in response to a computer signal to form an electrostatic latent image on an outer periphery of the photosensitive medium 130. The light emitting unit 110 has a light source (not shown) for emitting a laser beam as the light L, and a beam deflector for deflecting the laser beam emitted from the light source. A polygon mirror 112 rotated by a driving source (not shown) and reflecting the light may be utilized as the beam deflector, as shown in FIG. 2.

The developing cartridge 120 is detachably mounted to the housing 122, and the housing 122 is provided with the photosensitive medium 130, a charging roller 138, a developing roller 139, a supply roller 140, and an agitator 142. The developing cartridge 120 is formed with an opening 127 through which the light emitted from the light emitting unit 110 is irradiated onto the photosensitive medium 130.

The photosensitive medium 130 is disposed in such a way that a portion of an outer periphery is exposed. The photosensitive medium 130 has a metal cylindrical drum with a light conductive layer coated thereon through deposition or the like. The exposed outer periphery of the photosensitive medium 130 is placed opposite to the transfer roller 170. The photosensitive medium 130 is charged to a desired potential by the charging roller 138, and the electrostatic latent image corresponding to the image to be printed is formed on the outer periphery thereof in response to the computer signal by the light L emitted from the light emitting unit 110.

The charging roller 138 charges the outer periphery of the photosensitive medium 130 to a uniform potential before the light L is emitted from the light emitting unit 110. The charging roller 138 supplies the potential to the photosensitive medium 130 by rotating in contact with or in no contact with the outer periphery of the photosensitive medium 130, thereby providing the outer periphery of the photosensitive medium 130 with the uniform potential. The charging roller 138 is applied with a charging bias voltage to charge the outer periphery of the photosensitive medium 130 to the uniform potential. The charging roller 138 may be replaced by a corona charger (not shown).

The toner contained in the developing cartridge 120 adheres to the outer periphery of the developing roller 139. The developing roller 139 contains toner particles therein, and supplies the toner adhered thereon to the electrostatic latent image formed on the photosensitive medium 130 to develop the toner image. A developing bias voltage is applied to the developing roller 139 to supply the toner to the photosensitive medium 130. A developing gap of a desired interval may be formed between the developing roller 139 and the photosensitive medium 130. A force towards the developing roller 139 from the photosensitive medium 130 is generated by an electric field in the developing gap, and the charged toner reciprocates in a developing region formed between the developing gap to perform the development. The interval of the developing gap is from tens to hundreds of microns.

The supply roller 140 rotates in a desired direction to supply the toner towards the developing roller 139, so that the toner transferred from the agitator 142 adheres to the developing roller 139. The agitator 142 rotates with a predetermined speed to agitate the toner so that the toner transferred from the toner cartridge is not cured, and transfers the toner towards the supply roller 140.

Although not shown, the housing 122 is provided with a member (not shown) for restricting a height of the toner layer. One side of the restricting member is fixed to the housing 122, and the other side is in contact with the developing roller 139. As a result, the restricting member restricts the height of the toner layer adhered to the outer periphery of the developing roller 139, and frictionally charges the toner with a desired polarity. Preferably, the restricting member is made of a metal plate having resilient force. The metal plate may be a stainless steel plate, a phosphor bronze plate, or beryllium copper plate, with a thickness of 0.05 to 0.2 mm. Also, the housing is provided with a cleaning member (not shown). The cleaning member has one end forcibly contacting the photosensitive medium with a given pressure to scrape up the toner left on the photosensitive medium 130 after the transfer.

Figure 3:
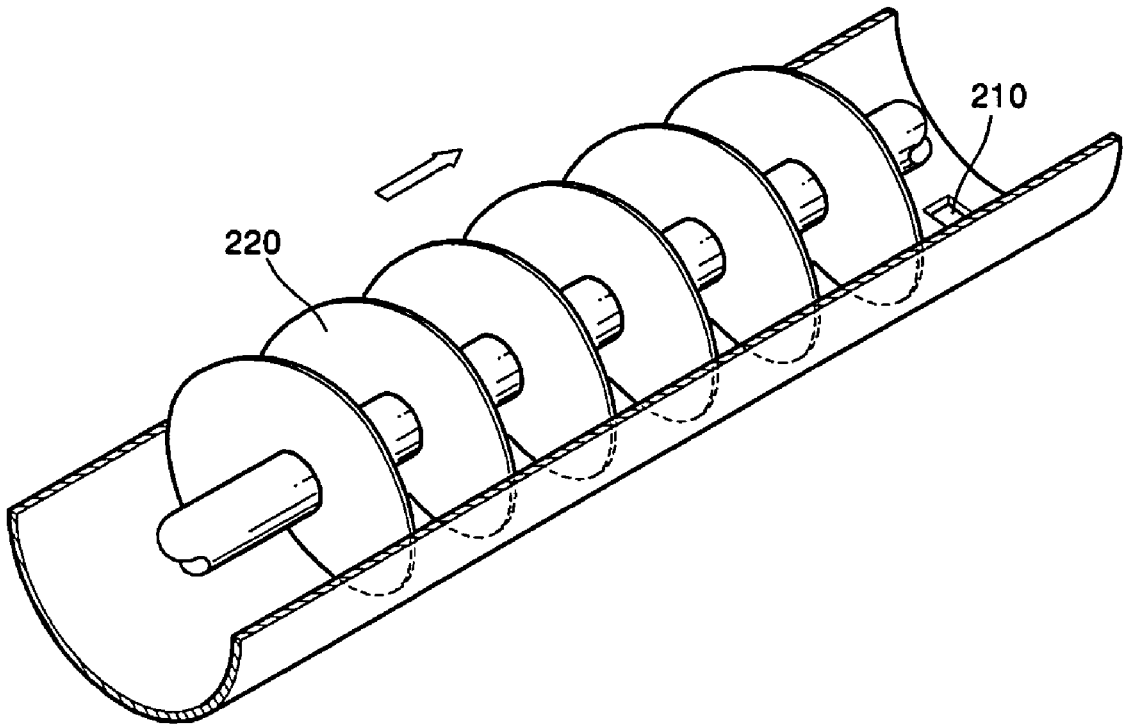
FIG. 3 is a partially cross-sectional view illustrating a portion of a toner cartridge according to an embodiment of the present invention.

FIG. 3 is a partial cross-sectional view illustrating a portion of the toner cartridge 200. Referring to FIGS. 2 and 3, the toner cartridge 200 and the housing 250 for accommodating the toner cartridge 200 are installed above the light emitting unit 110.

The toner cartridge 200 stores the toner, and is provided at one side thereof with a toner supply window 210 for supplying the stored toner to the exterior. The toner cartridge 200 has a toner transfer member 220 for transferring the stored toner to the toner supply window 210. The toner transfer member 220 is formed in a spiral screw, and rotates in a desired direction to transfer the stored toner to the toner supply window 210. Preferably, the toner transfer member 220 is an auger. The toner transferred to the toner supply window 210 is supplied to an entrance of a movable member 280 by gravity, and is transferred to the developing cartridge 120 through the movable member 280.

Figure 4:
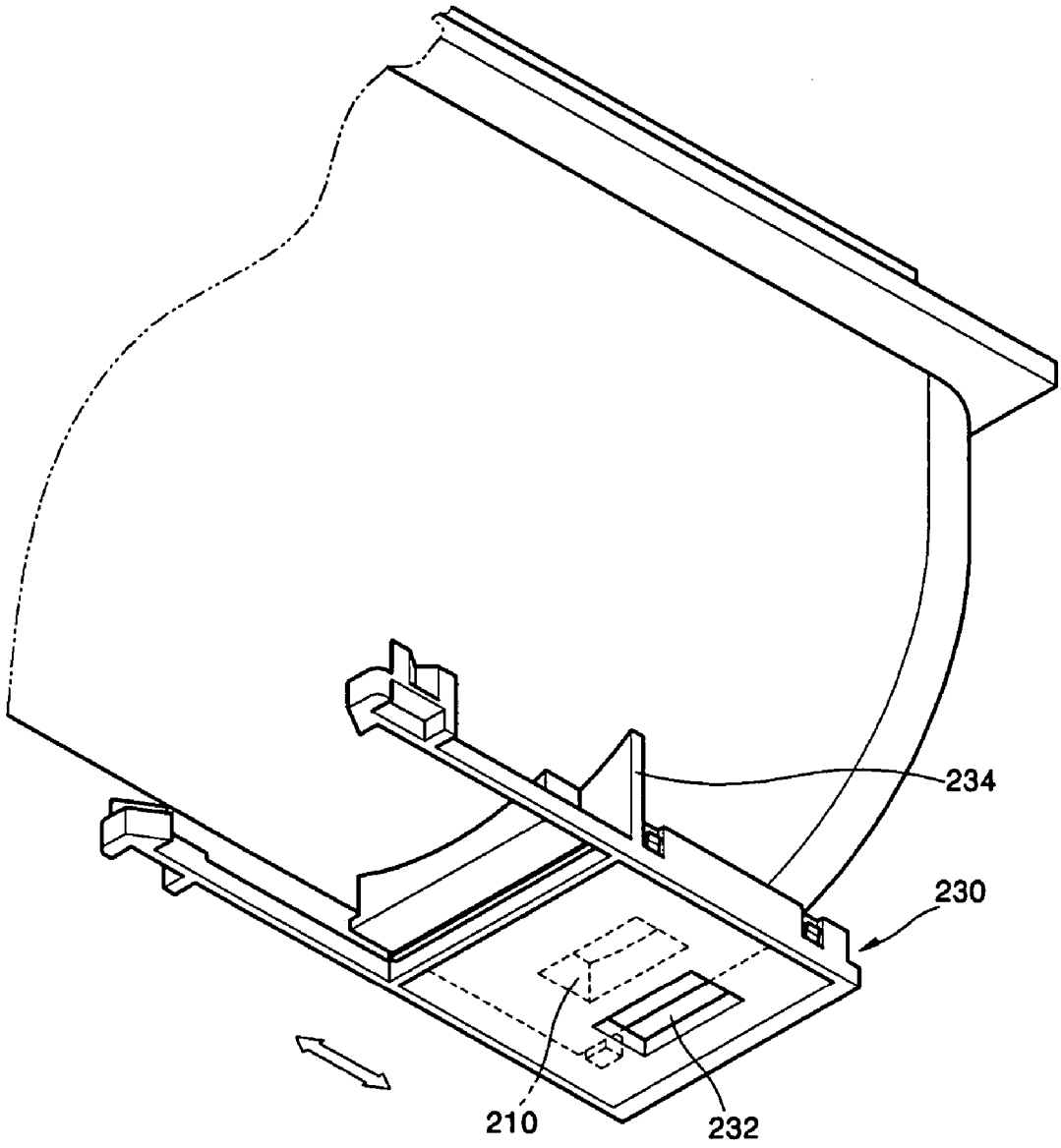
FIG. 4 is a view illustrating a position of a shutter before the toner cartridge is attached to a housing.
Figure 5:
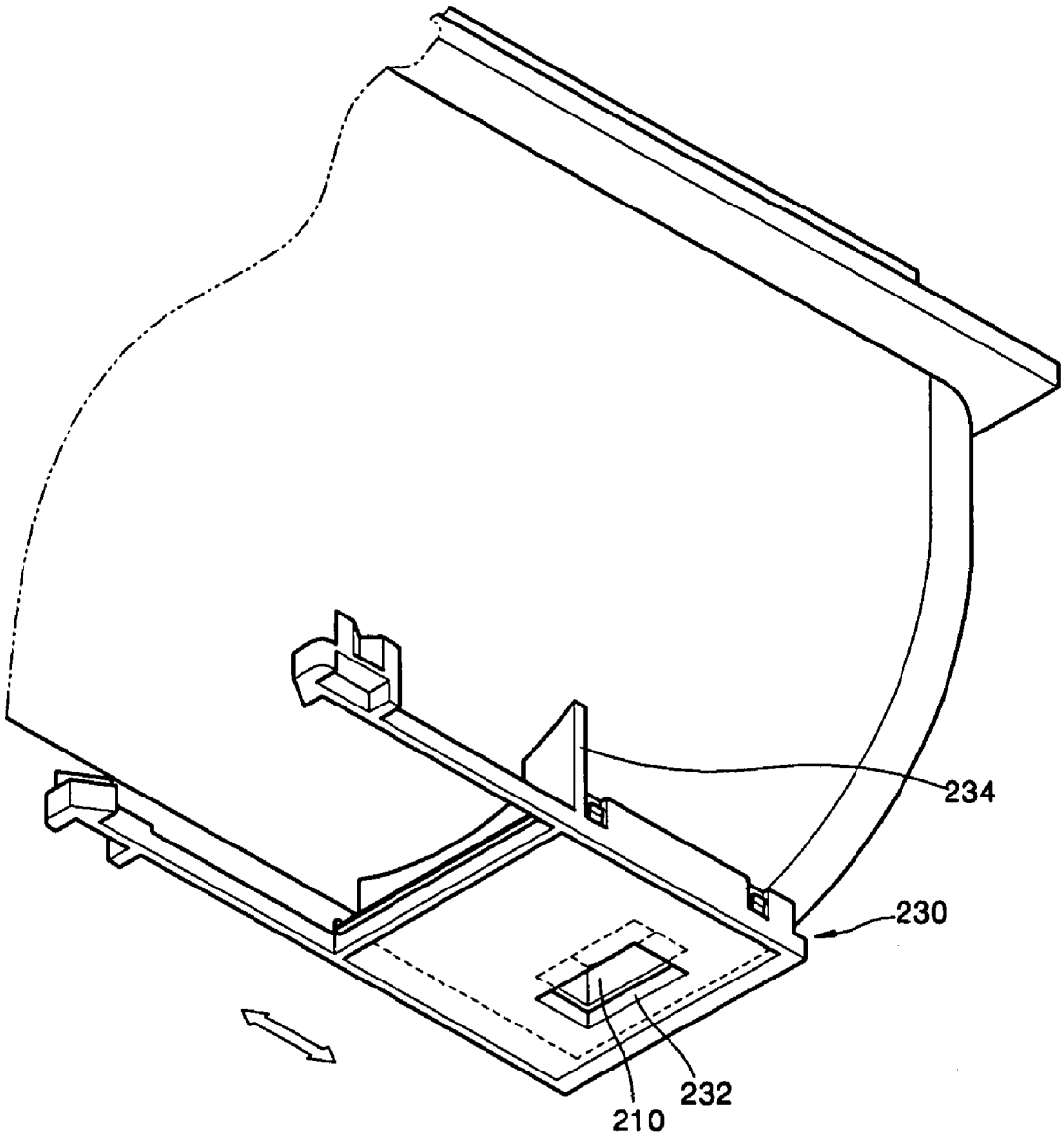
FIG. 5 is a view illustrating a position of a shutter after the toner cartridge is attached to the housing.

FIG. 4 is a view illustrating a position of the shutter 230 before the toner cartridge 200 is attached to the housing 250, while FIG. 5 is a view illustrating a position of the shutter 230 after the toner cartridge 200 is attached to the housing 250. Referring to FIGS. 4 and 5, the shutter 230 is installed so that it opens or closes the toner supply window 210 when the toner cartridge 200 is attached to or detached from the housing 250. Although not concretely shown in FIG. 4, a protrusion 234 formed on one side of the shutter 230 interferes with a boss (not shown) provided on the housing 250 when the toner cartridge 200 is attached to the housing 250, so that the shutter 230 slides in an arrow direction shown in FIGS. 4, 5 and 6. When the toner cartridge 200 is attached to the housing 250, as shown in FIG. 5, the opening 232 formed at the shutter 230 coincides with the toner supply window 210. Hence, the toner is supplied into the developing cartridge 120 through the toner supply window 210. When the toner cartridge 200 is detached from the housing 250, the shutter 230 is returned to its original position (shown in FIG. 4) by a resilient member (not shown) such as a spring. That is, the shutter 230 slides to open or close the toner supply window 210 when the toner cartridge 200 is attached or detached from the housing 250, respectively.

The shutter 230 may be any one of various conventional types. The construction of the shutter 230 is widely known in the related art, and thus the description thereof will be omitted herein.

Figure 6:
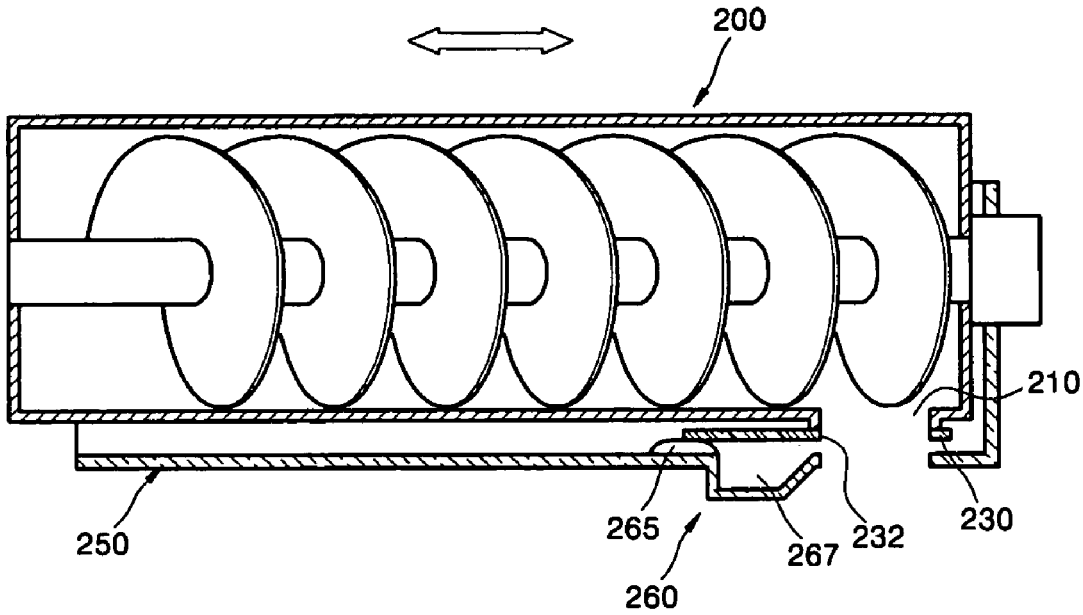
FIG. 6 is a cross-sectional view illustrating a toner cartridge according to another embodiment of the present invention, the toner cartridge being attached to a housing.

FIG. 6 is a cross-sectional view illustrating the toner cartridge 200 according to an embodiment of the present invention attached to the housing 250.

The housing 250 is provided with a toner receptacle 267 for accommodating the toner that leaks from the toner cartridge 200 when the toner cartridge 200 is attached to or detached from the housing 250. The toner receptacle 267 is formed in a concave shape so that the toner leaking from the toner cartridge 200 is stored in the toner receptacle 267. In addition, the toner receptacle 267 is detachably installed to the housing 250 so that the toner can be easily removed when a predetermined amount of the toner is stored therein.

A toner remover 260 is disposed on the housing 250. The toner remover 260 is closely provided near an outer periphery of the toner cartridge 200 (for example, shutter 230) so it can remove the toner adhered to the shutter 230 when the toner cartridge 200 is detached in an arrow direction. Specifically, the toner remover 260 is in contact with the outer periphery of the toner cartridge 200 with a predetermined pressure, so as to remove the toner which leaks through the toner supply window 210 and shutter 230 during installation or removal. Thus, the toner adhered to the outer periphery of the toner cartridge 200 is removed so that the image forming apparatus is not fouled by loose toner.

The toner remover 260 includes a toner removing member 265 protruding from the inner periphery of the housing 250. The toner removing member 265 removes the toner adhered to the outer periphery of the toner cartridge 200 and captures the removed toner in the toner receptacle 267. The toner removing member 265 is provided at one side thereof contacting the shutter 230 with a resilient member to improve the efficiency of removing the toner.

Figure 7:
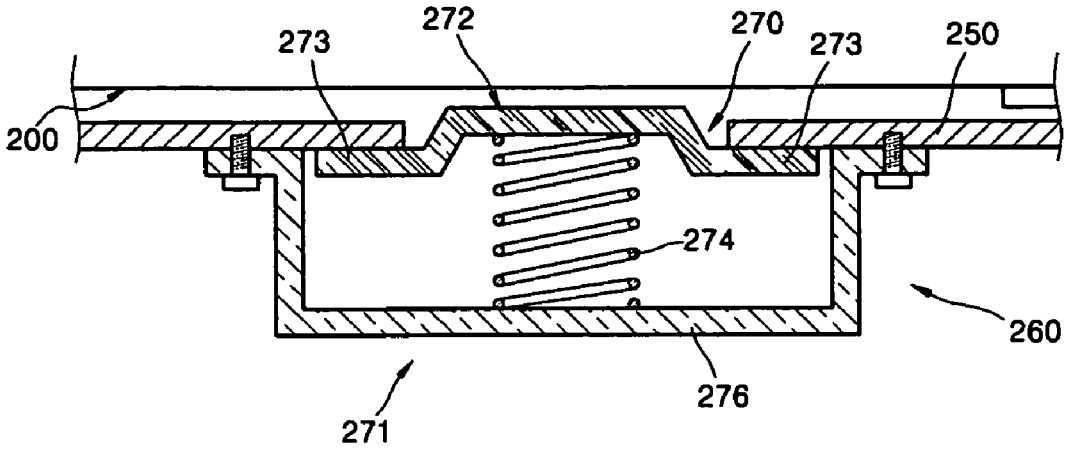
FIGS. 7 and 8 are views illustrating a toner cartridge according to another embodiment of the present invention attached to a housing for toner cartridge.
Figure 8:
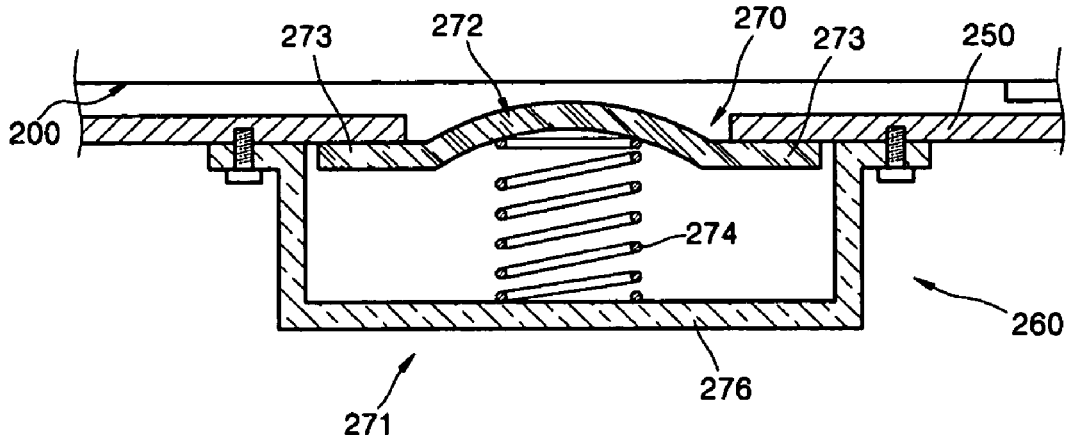

FIGS. 7 and 8 are views illustrating a toner cartridge 200, according to another embodiment of the present invention, which is attached to the housing 250. Components having the same functions and effects as those in the above embodiment are indicated by like numbers.

Referring to FIGS. 7 and 8, the toner remover 260 includes an opening 270 formed at one side of the housing 250, and a biasing portion 271 provided to the opening 270 for pressing against the shutter 230 to remove the toner adhered to the shutter 230 during installation or removal of the toner cartridge 200.

Specifically, the opening 270 is formed at one side of the housing 250 corresponding to a trajectory of the shutter 230 moving when the toner cartridge 200 is detached from the housing 250. The biasing portion 271 is provided to the opening 270 for pressing the outer periphery of the toner cartridge 200 (for example, the shutter 230) to remove the toner adhered to the shutter 230.

The biasing portion 271 has a first member 272 contacting the shutter 230 with a predetermined pressure, a second member 276 installed to the housing 250 for covering the opening 270, and a resilient member 274 installed between the first member 272 and the second member 276 for biasing the first member 272. The resilient member 274 biases the first member 272 against the opening 270 so that the first member 272 closely contacts the outer periphery of the toner cartridge 200 when the toner cartridge 200 is detached from the housing 250, so as to remove the toner adhered to the shutter 230 and leaking out of the toner cartridge 200. One side of the first member 272 is connected to the resilient member 274, and the other side is protruded from the housing 250 in a direction toward the toner cartridge 200. Specifically, the first member 272 contacts the outer periphery of the toner cartridge 200 with the predetermined pressure to clean the toner leaking through the toner supply window 210 and thus adhering to the outer periphery of the toner cartridge 200. One side of the first member 272 contacting the outer periphery of the toner cartridge 200 is made of a resilient material to improve the removing efficiency of the toner.

The first member 272 is provided with an interfering portion 273 interfering with the housing 250 for restricting a movement of the first member 272. The interfering portion 273 prevents the first member 272 biased by the resilient member 274 from escaping through the opening 270. That is, the first member 272 is maintained at a constant height by the interfering member 273 and resilient member 274.

In FIG. 8, the first member 272 has a convex portion protruding towards the opening 270. Also, the convex portion point-contacts the shutter 230. The leaked toner removed by the first member 272 is collected in one side of the first member 272, and then flows down along the interfering portion 273 by vibration resulting from the detachment of the toner cartridge 200 so as to be stored in the second member 276. Alternatively, the housing 250 may be provided at one side thereof with a toner accommodating portion for storing the leaked toner removed by the first member 272 similar to the toner receptacle 267 shown in FIG. 6.

Alternatively, the toner cartridge 200 may be provided with a guide rib (not shown) for easily attaching/detaching it from the housing 250. That is, the guide rib slides on one side of the housing 250 to guide the toner cartridge 200.

Referring to FIGS. 2 and 3, the toner supplied from the toner supply window 210 is transferred to the developing cartridge 120 by the movable member 280. The movable member 280 is provided with a resilient auger therein. The auger has a spiral wing, and the spiral wing is rotated in a desired direction to transfer the toner supplied through the toner supply window 210 to the developing cartridge 120.

The transfer roller 170 is placed opposite to the outer periphery of the photosensitive medium 130. The transfer bias voltage of a polarity opposite to that of the toner image is applied to the transfer roller 170 so as to transfer the toner image developed on the photosensitive medium 130 onto paper. The toner image developed on the outer periphery of the photosensitive medium 130 is transferred onto the paper by the static electricity acting between the photosensitive medium 130 and the transfer roller 170. Alternatively, the toner image developed on the outer periphery of the photosensitive medium 130 may be transferred onto the paper passing through the photosensitive medium 130 and the transfer roller 170 by the contacting pressure therebetween.

The fixing portion includes a heat roller 176 and a press roller 177 disposed opposite to the heat roller 176 to fix the toner image on the paper by applying heat and pressure thereto. The heat roller 176 is disposed opposite to the press roller 177 as a heat source to permanently fix the toner image.

When the paper passes through the fixing unit 175, the paper is curled by the heat. The curl of the paper is removed by a decurl unit 178. The completely fixed paper is discharged from the image forming apparatus 100 by a plurality of delivery rollers 179, 182, 183 and 184, and is then stacked on the delivery tray 102.

The image forming apparatus 100 also includes a paper feeding cassette 105. Also, the image forming apparatus 100 includes a multi-purpose feeder (not shown) for stacking the paper thereon. The multi-purpose feeder is mainly used for overhead projector (OHP) paper or non-standard paper. The paper feeding cassette 105 includes a knock-up plate 106 for stacking the paper thereon, and a resilient member 107 for biasing the knock-up plate 106 against the pickup roller 180. The pickup roller 180 picks up a single sheet of paper from the paper stacked on the paper feeding cassette 105. The feed roller 181 feeds the picked up paper to a registration roller 190. The registration roller 190 aligns the paper so that the toner image is transferred onto a desired portion of the paper before the paper passes between the photosensitive medium 130 and the transfer roller 170. The paper transferred as described above passes between the photosensitive medium 130 and the transfer roller 170, and the toner image is then transferred onto the paper. The toner image transferred on the paper is fixed on the paper by the fixing unit 175, and the paper is discharged outwardly through the image forming apparatus 100 by the delivery rollers 179, 182, 183 and 184.

An operation of the image forming apparatus according to an embodiment of the present invention will now be described.

Referring to FIG. 2, the photosensitive medium 130 of the developing cartridge 120 is charged to a uniform potential by the charging bias voltage applied to the charging roller 138. The light emitting unit 110 emits the light L corresponding to the image information onto the photosensitive medium 130 of the developing cartridge 120 through the opening 127. The portion of the photosensitive medium 130 where the light is incident is selectively neutralized, and thus the potential on that portion of the photosensitive medium 130 is lowered. As a result, the electrostatic latent image is formed by the potential difference of the portion exposed to the light L.

The toner contained in the toner cartridge 200 is transferred to the toner supply window 210 by the toner transfer member 220. The toner transfer member 220 is rotated in a desired direction by the drive source (not shown) to transfer the toner. The toner transferred to the toner supply window 210 drops freely onto the entrance of the movable member 280 by gravity, and is then moved to the developing cartridge 120 by the movable member 280. The toner moved to the developing cartridge 120 is agitated by the agitator 142, and is then supplied to the developing roller 139 to which the developing bias voltage is applied by the supply roller 140. The toner adhered to the outer periphery of the developing roller 139 is thinned to a uniform thickness by the toner layer restricting member (not shown). At this time, the toner rubs against the toner layer restricting member to be charged to a desired potential. The toner adhered to the outer periphery of the developing roller 139 is adhered to the electrostatic latent image formed on the outer periphery of the photosensitive medium 130, thereby forming the toner image on the photosensitive medium 130.

The paper is drawn out from the paper feeding cassette 105 by the pickup roller 180. The paper is transferred to the registration roller 190 by the feed roller 181, is aligned by the registration roller 190, and passes between the photosensitive medium 130 and the transfer roller 170. When the transfer bias voltage is applied to the transfer roller, the toner image formed on the photosensitive medium 130 is transferred onto the paper.

After the transfer, the toner left on the outer periphery of the photosensitive medium 130 is removed by the cleaning member (not shown). The fixing unit 175 applies the heat and pressure to the toner image formed on the paper to fix the toner image on the paper. The curl generated on the paper by the heat is removed by the decurling unit 178. The paper passed the decurl unit 178 is discharged from the image forming apparatus 100 by a plurality of delivery rollers 179, 182, 183 and 184, and is then stacked on the delivery tray 102.

The image forming apparatus 100 forms the image on the paper by repeating the above process. When the toner from the toner cartridge 200 is exhausted, the toner cartridge 200 has to be replaced. When the shutter 230 is closed when replacing the toner cartridge 200, a minor amount of the toner leaks outwardly, and thus adheres to the outer periphery of the toner cartridge 200. Specifically, when the toner cartridge 200 is replaced, the toner leaking through the toner supply window 210 may adhere to the outer periphery of the toner cartridge 200 and foul the inside of the image forming apparatus 100. The toner adhered to the outer periphery of the toner cartridge 200 is removed by the toner remover 260. As a result, the toner leaked through the toner supply window 210 does not leak outside of the housing 250.

Aspects of the present invention provide a separate unit for cleaning the toner adhered to the outer periphery of the toner cartridge 200 in order to prevent toner leakage in the image forming apparatus employing the bottle-type toner cartridge.

Specifically, the image forming apparatus according to embodiments of the present invention includes the toner remover for removing the toner adhered to the outer periphery of the toner cartridge. As a result, the inner and outer peripheries of the image forming apparatus are not polluted, and the components of the image forming apparatus function properly.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An image forming apparatus, comprising:

a toner cartridge storing a toner and having a toner supply window to supply the toner;

a housing detachably accommodating the toner cartridge; and a toner receptacle provided to the housing to receive the toner that leaks from the toner cartridge, when the toner cartridge is attached to or detached from the housing, wherein the toner cartridge comprises:

a shutter coupled to the toner cartridge, opening and closing the toner supply window, when the toner cartridge is attached to or detached from the housing, respectively; and a toner remover coupled to the housing to remove the toner that leaks from the toner cartridge, when the toner cartridge is attached to or detached from the housing.

2. The image forming apparatus according to claim 1, wherein the toner cartridge comprises a toner transfer member installed in the toner cartridge to transfer the toner stored in the toner cartridge to the toner supply window.

3. The image forming apparatus according to claim 2, wherein the toner transfer member is a rotatable auger.

4. The image forming apparatus according to claim 1, wherein the toner remover is disposed on the housing, and is provide near an outer periphery of the toner cartridge so as to remove the toner that leaks through the toner supply window and the shutter, when the toner cartridge is attached to or detached from the housing.

5. The image forming apparatus according to claim 4, wherein the toner remover comprises a toner removing member protruding from an inner periphery of the housing.

6. The image forming apparatus according to claim 5, wherein the toner receptacle is detachably coupled to the housing.

7. The image forming apparatus according to claim 4, wherein the toner remover comprises:

an opening formed at one side of the housing corresponding to a moving trajectory of the shutter when the toner cartridge is attached to or detached from the housing; and a biasing portion provided to the opening pressing the shutter to remove the toner adhered to the shutter when the toner cartridge is detached from the housing.

8. The image forming apparatus according to claim 7, wherein the biasing portion comprises:

a first member contacting the shutter to remove the toner leaking from the housing;

a second member coupled to the housing to cover the opening; and a resilient member installed between the first member and the second member biasing the first member against the opening.

9. The image forming apparatus according to claim 8, wherein the first member has an interfering portion interfering with the housing to restrict a movement of the first member to prevent the first member from passing through the opening.

10. The image forming apparatus according to claim 9 wherein the interfering portion and the resilient member maintain the first member at a constant height.

11. The image forming apparatus according to claim 9, wherein the first member has a convex portion protruding towards the opening.

12. The image forming apparatus according to claim 11, wherein the convex portion point-contacts the shutter.

13. The image forming apparatus according to claim 12, further comprising a toner storing portion storing the toner removed by the first member.

14. The image forming apparatus according to claim 13, wherein the toner storing portion is detachably coupled to the housing.

15. A cleaning unit for use in an image forming apparatus to remove residual toner from an outer portion of a toner cartridge, comprising:

cleaning means for removing the residual toner on the outer portion of the toner cartridge, the cleaning means contacting the toner cartridge during removal and installation;

a housing supporting the cleaning means and detachably accommodating the toner cartridge in the image forming apparatus; and collecting means for collecting the residual toner removed by the cleaning means, wherein the collecting means contact the housing.

16. The cleaning unit of claim 15, wherein the collecting means is integrally formed with the housing.

17. The cleaning unit of claim 15, wherein the collecting means is detachably coupled with the housing.

18. An image forming apparatus utilizing a replaceable toner cartridge to supply toner to form toner images, comprising:

a housing to accommodate the toner cartridge and supply the toner from the toner cartridge to the image forming apparatus;

a cleaner to remove residual toner from an outer surface of the toner cartridge during installation and removal of the toner cartridge; and a collector to store the removed residual toner cleaned from the outer surface of the toner cartridge.

19. The image forming apparatus of claim 18, wherein the collector is detachably coupled with the housing.

20. The image forming apparatus of claim 18, wherein the cleaner is biased against the outer surface of the toner cartridge during installation and removal.

21. An image forming apparatus, comprising:

an image developer cartridge;

a bottle-type toner cartridge to store toner, and provided with a toner supply window to supply to toner to the image developer cartridge;

a housing to accommodate the toner cartridge;

a shutter disposed on the housing, to open or close the toner supply window, when the toner cartridge is installed in or removed from the housing;

a toner remover disposed on the housing and provided near an outer periphery of the toner cartridge, to remove residual toner from an outer surface of the toner cartridge, when the toner cartridge is installed in or removed from the housing; and a toner receptable coupled to the housing, to store the residual toner removed from the outer surface of the toner cartridge.

22. The image forming apparatus of claim 21, wherein the toner remover comprises:

a body installed to the housing to cover an opening formed at one side of the housing;

a toner removing member arranged to protrude, via the opening of the housing, and biased to press against the outer surface of the toner cartridge to remove the residual toner that leaks through the toner supply window and the shutter, when the toner cartridge is installed in or removed from the housing.

23. The image forming apparatus of claim 21, wherein the toner cartridge is provided with a rotatable auger to transfer the toner stored in the toner cartridge to the toner supply window.

* * * * *